United States Patent [19]

Luogameno

[11] 4,222,679

[45] Sep. 16, 1980

[54] LOOSE-LEAF BINDER

[75] Inventor: Felix Luogameno, Bergenfield, N.J.

[73] Assignee: American Loose Leaf Corporation, Clifton, N.J.

[21] Appl. No.: 958,606

[22] Filed: Nov. 8, 1978

[51] Int. Cl.[3] ..... B42F 3/04

[52] U.S. Cl. ..... 402/75

[58] Field of Search ..... 402/74, 75; 24/211 L

[56] References Cited

U.S. PATENT DOCUMENTS

| | | | |
|---|---|---|---|
| 1,889,230 | 11/1932 | Unger | 402/75 |
| 2,886,039 | 5/1959 | Lotter | 402/75 |

*Primary Examiner*—John McQuade

*Attorney, Agent, or Firm*—Stephen E. Feldman; Marvin Feldman

[57] ABSTRACT

A loose-leaf binder mechanism comprises top and bottom covers. A backbone connects the top and bottom covers. A binding mechanism includes a detachable longitudinal bar. The detachable longitudinal bar has a projection with a groove thereon extending therefrom. A channel guide is affixed to one of the covers. A flat latching bar is reciprocally received within the channel guide for cooperating with the projection to join the binding mechanism to one of the covers. An indented structure on the channel guide substantially restricts the movement of the latching bar to reciprocal movement.

12 Claims, 4 Drawing Figures

LOOSE-LEAF BINDER

BACKGROUND OF THE INVENTION

While the invention is subject to a wide range of applications, it is especially related to loose-leaf binder applications and will be particularly described in that connection.

Until the present invention, loose-leaf binders with a sheet-holding unit which was detachably coupled to the binder cover required a coupling device having a large number of parts and were, therefore, relatively expensive to manufacture and/or replace. A number of patents have illustrated various types of detachable loose-leaf mechanisms. For example, U.S. Pat. No. 2,886,039 to Lotter illustrates a latching mechanism 19, including a tubular guide 51 and a latch bar 52 which reciprocates therein. Note that the latch bar 52 requires a stop pin 60, see FIG. 2, to limit the movement of the latch bar. The present invention, on the other hand, does not require additional stop pins and their corresponding holes, but rather simplifies the construction as will be explained. In addition, U.S. Pat. No. 3,748,051 to Frank and U.S. Pat. No. 2,791,220 to McBee, illustrate other types of loose-leaf binder mechanisms.

A further type of detachable loose-leaf mechanism includes a latching bar reciprocally received within the channel guide where the latching bar is shaped substantially like the channel guide, ie. with a top section and two side sections extending therefrom. The two side sections support the latching bar and substantially permits only reciprocal movement.

It is an object of the present invention to provide a loose-leaf binder mechanism which includes a flat latching bar.

It is a further object of the present invention to provide a loose-leaf binder mechanism with a channel guide to limit movement of the latching bar.

It is an additional object of the present invention to provide a loose-leaf binder mechanism which is relatively inexpensive to manufacture.

SUMMARY OF THE INVENTION

In accordance with the present invention, there is disclosed a loose-leaf binder mechanism comprising top and bottom covers. A back-bone connects the top and bottom covers. A binding mechanism includes a detachable longitudinal bar. The detachable longitudinal bar has a projection with a groove thereon extending therefrom. A channel guide is affixed to one of the covers. A flat latching bar is reciprocally received within the channel guide for cooperating with the projection to join the binding mechanism to one of the covers. An indented structure on the channel guide substantially restricts the movement of the latching bar to reciprocal movement.

For a better understanding of the present invention, together with other and further objects thereof, reference is made to the following descriptions, taken in connection with the accompanying drawings, while its scope will be pointed out in the appended claims.

DESCRIPTION OF THE PREFERRED EMBODIMENT

Figure 1:
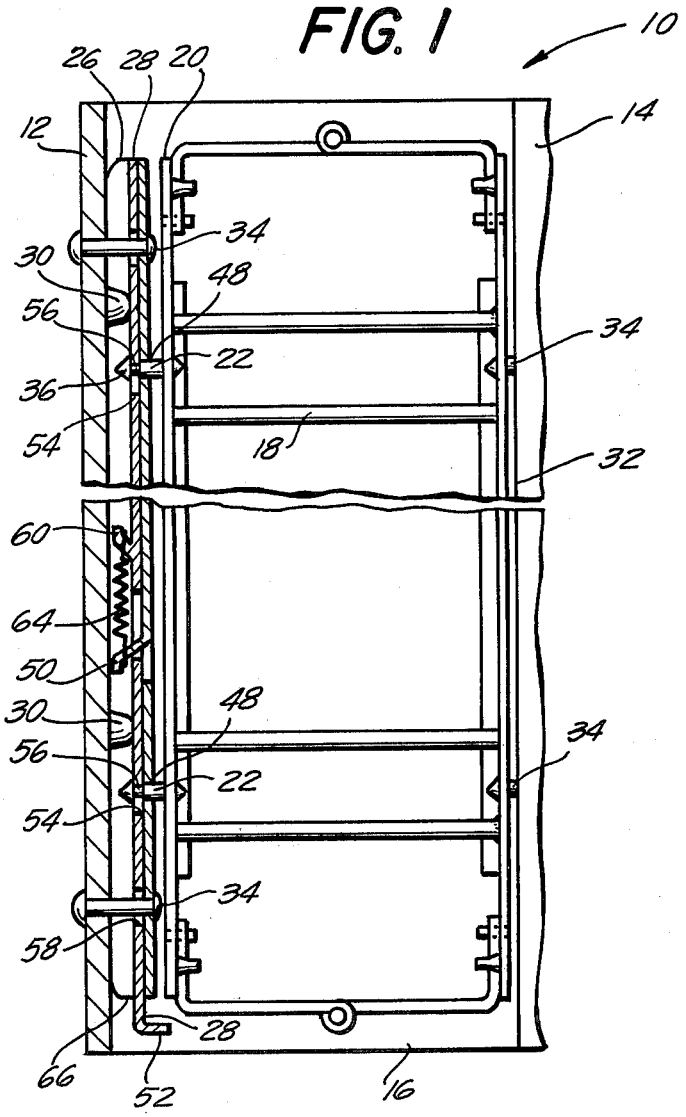
FIG. 1 is a top view, illustrating a loose-leaf binder mechanism attached to a loose leaf binder in accordance with the present invention.

In accordance with the present invention, a loose-leaf binder mechanism 10 comprises a top cover 12 and a bottom cover 14. A backbone 16 connects the top and bottom covers. A binder mechanism 18 includes a detachable longitudinal bar 20. The bar has a projection 22 with a groove 24 thereon, extending from the bar 20. A channel guide 26 may be affixed to either of the covers 12 or 14. A flat latching bar 28 is reciprocally received within the channel guide 26 for cooperating with the projection 22 and joining the binding mechanism 18 to one of the covers. Indented structure 30 is provided on the channel guide 26 to substantially restrict the movement of the latching bar 28 to reciprocal movement.

Referring to FIG. 1, there is an illustration of a loose-leaf binder mechanism 10 which may be used for holding sheafs of paper. The binding mechanism comprises top cover 12, bottom cover 14 and a backbone 16 to connect the two covers. These covers may be made of any conventional material, such as for example, plastic, metal, or cardboard covered with some desirable material.

The binding mechanism 18, consists of two longitudinal prong bars 20 and 32, which act as support members and are attached to the covers 12 and 14. Bar 32 may be permanently attached to a cover 14 by any desirable means, such as rivets 34. Although the longitudinal bar 32 is illustrated as being permanently attached, it is within the scope of the present invention to detachably connect the bar to the cover as will be explained with the detachable longitudinal bar 20. The specific mechanism used to hold the paper is not a part of the present invention and may be of any desirable type, such as for example, the mechanism described in commonly owned U.S. patent application Ser. No. 830,969 has now issued into U.S. Pat. No. 4,127,340.

Figure 2:
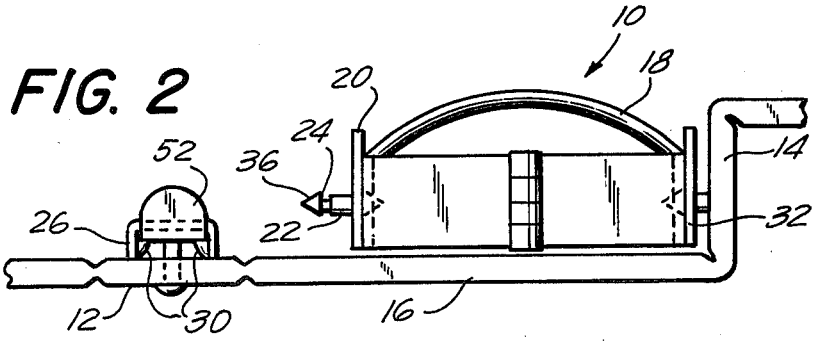
FIG. 2 is a side view of a loose-leaf binder mechanism with the covers open, in accordance with the present invention.

The binding mechanism 18, includes a detachable longitudinal bar 20, which may be releasably attached to a cover 12. The projections 22 may be cylindrical in shape, see FIG. 2, and include a circumferential groove 24 thereon. In addition, although the projection 22 may have a substantially pointed conical and 36, as shown, it is within the scope of the present invention to provide an end of any desirable shape, such as for example, rounded or frustroconical. Further, although two projections are illustrated and described in the operation of the present embodiment, it is within the scope of the present invention to use either one or as many projections 22 as deemed desirable.

Figure 4:
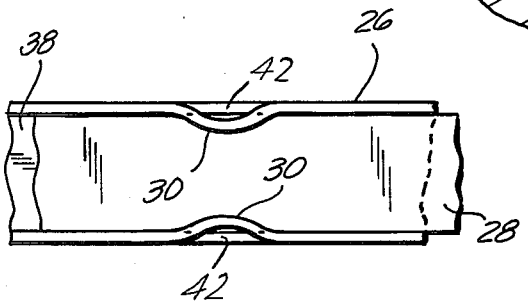
FIG. 4 is a view illustrating the details of the channel guide.

A channel guide 26, may be affixed to a top cover 12 by any desirable means, such as for example, rivets 34. The channel guide has a unitary construction with a top section 38 and two side sections 40 extending from the top section. Each of the side sections has an indentation 30 which may be place opposite an indentation on the other side section to permit reciprocal movement the latching bar 20 between the indentations and top section 38, as will be further explained. Although four indentations are illustrated, two opposing each other in two separate locations, it is within the scope of the present invention to provide a minimum of two indentations. In this example, one indentation may be provided on each side section, but they need not be opposite one another. Also, any number of indentations, in any desired locations on the side sections 40, may be provided. In constructing the indentations, a small cut 42 is made at a desired distance from the top section 38. Then the side section is indented to the bottom edge 44, of the side section 40 (see FIG. 4). The distance of the cut from the bottom face 46 of the top section 38 is slightly greater than the thickness of the flat latching bar 28 for reasons which will be explained.

The channel guide also includes a number of apertures 48 for receiving a corresponding number of projections 22. In addition, indentations 30 are preferrably located adjacent the apertures 48 for reasons as will be explained. Also, the channel guide 26 includes a channel bias projection 50 for receiving one end of a coil spring 64. The projection may be stamped out of the top section 38 of guide 26.

Figure 3:
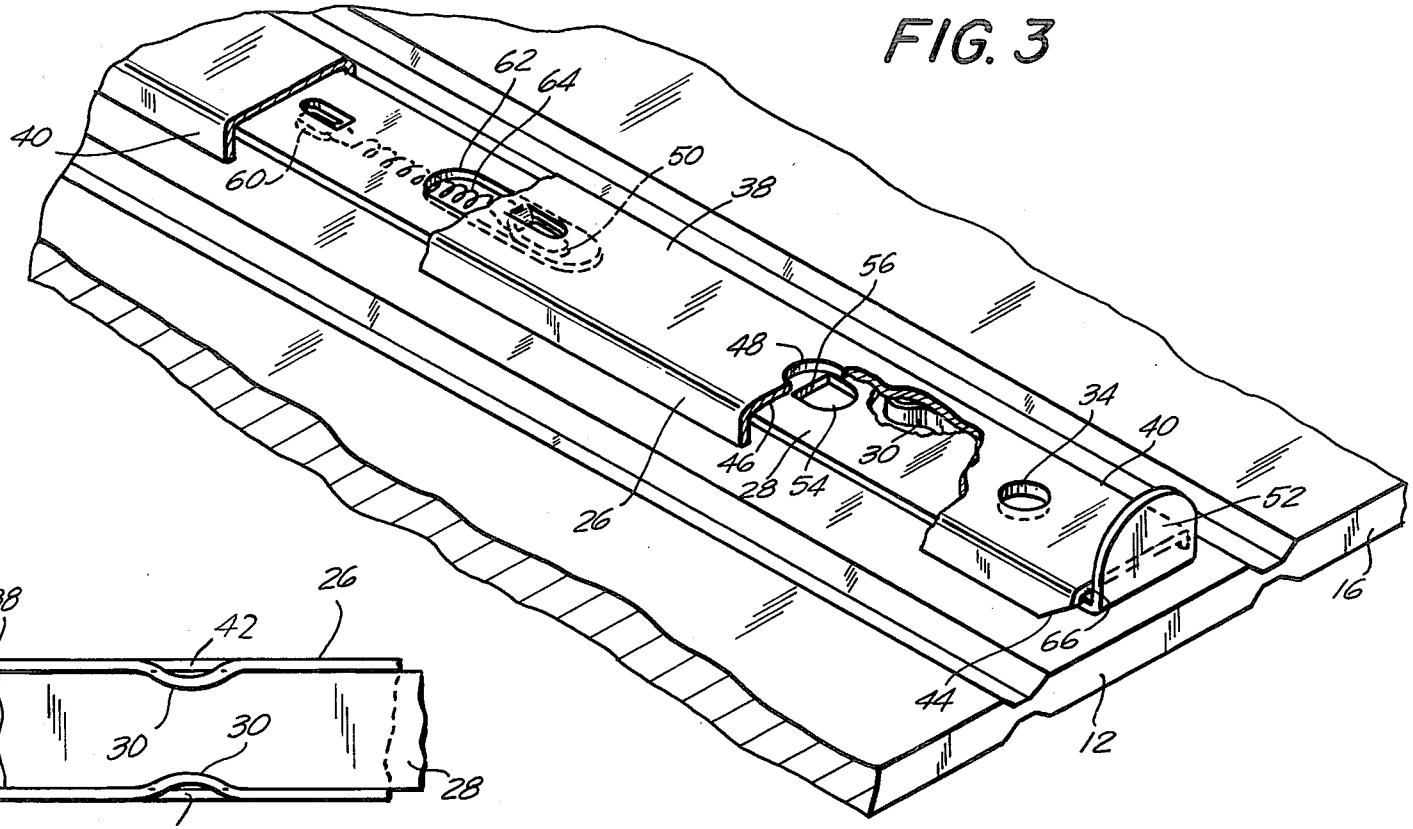
FIG. 3 is a perspective view, partly in cross section of a latching bar in a channel guide.

Referring to FIGS. 1 and 3, there is illustrated the details of a flat latching bar 28. It is reciprocally received within the channel guide 26 and co-operates with the projections 22 to join the binding mechanism 18 to cover 12 as will be further explained. The latching bar 28 is made from a flat piece of material, such as for example steel, and includes a projecting tab 52 on one end for moving the latching bar. In addition, latching apertures 54, which may have a straight side 56, are provided to correspond with the number of apertures 48 located in channel guide 26.

The latching bar also includes limit apertures 58 which receive the pin members 34. There apertures are of a desired diameter so as to restrict the reciprocal movement of the latching bar within the channel guide. The flat latching bar includes a latching bias projection 60 for receiving one end of a coil spring 64. The projection may be stamped out of the latching bar. This efficient stamping process is available because the latching bar is flat and no significant defamation problems occur in this type of construction. A bias aperture 62, which may be located adjacent the latching bias projection 60, permits reciprocal movement of the latching bar without interference with channel bias projection 50. When the latching bar is assembled in the channel guide, a coil spring 64 between the bias projection 50 and 60 is provided to biases the projecting tab 52 away from the end 66 of channel guide 26. Note that the straight sides 56 of the latching apertures 54 are located on the same side of aperture 54. This, when latching bar 28 moves towards the end 66 of channel guide 26, both of the straight sides 56 may coact with the groove 24 of projection 22.

The use of the new binding mechanism as just described is as follows: when it is desired to open a binder composed of a top cover, bottom cover, a backbone and a binding mechanism, such as when pages are to be inserted, removed, or both inserted and removed, it is first necessary to separate one of the covers, such as top cover 12, from the binding mechanism 18. This procedure is done by pushing tab 52 towards the end 66 of channel guide 26. This movement against the bias of spring 64 causes the straight sides 56 of the latching apertures 54 to disengage from the groove 24 in projections 22. The distance of reciprocal movement of latching bar 28 is limited by the limit apertures 58 which contact the pin members 34. The limitation of reciprocal movement is required so that the latching apertures 54 do not again move into the grooves 24 and prevent the removal of projections 22 from the latching apertures 54. At this point, the top cover 12 may be pulled off the longitudinal bar 20 and thereby permit the binding mechanism 18 to open so that the enclosed papers may be rearranged.

When it is desired to close the loose-leaf binder again, it is only necessary to press the channel guide 26 against the projections 22 located on longitudinal bar 20. Since the projections 22 have pointed ends 36, they easily pass through the apertures 48 and push against the latching apertures 54 to move the latching bar 28 away from the end 66 of the channel guide. When the grooves 24 are aligned with latching apertures 54, the latching bar 28 is pushed toward the end 66 so that the straight sides 56 of the latching apertures moves into the grooves 24 and thereby joins the cover 12 to the mechanism 18. In order for this latter operation to occur smoothly and without any special attention and manipulation of the latching bar 28, the indentation 30, as explained above, substantially restrict the movement of the latching bar to only reciprocal movement. If on the other hand, the indented structure was not provided, the latching bar could have additional freedom of movement and substantially inhibit the movement of straight side 56 into the grooves 24.

Further although not illustrated, it is within the scope of the present invention to provide a similar connecting mechanism to attach a second longitudinal bar 32 to a bottom cover 14.

One skilled in the art will realize that there has been disclosed a loose-leaf binder mechanism which includes a latching bar that is flat, a channel guide that limits movement of the latching bar, and is relatively inexpensive to manufacture.

While there has been described what is at present considered a preferred embodiment of the invention, it will be obvious to one skilled in the art that various changes and modifications may be made therein without departing from the invention, and it is, therefore aimed in the appended claims, to cover all such changes and modifications as followed in the true spirit and scope of the invention.

What is claimed is:

1. A loose leaf binder mechanism comprising: top and bottom covers, a backbone connecting said top and bottom covers, a binding mechanism including a detachable longitudinal bar affixed to one of said covers, said detachable longitudinal bar having a projection with a groove thereon extending therefrom, a channel guide affixed to one of said covers, a flat latching bar reciprocally received within said channel guide for cooperating with said projection to join said binding mechanism to one of said covers, and indented means formed on the opposing sides of said channel guide and slidingly contacting the latching bar so as to provide a bearing surface as the latching bar slides between the top and sides of the channel, and the top of the indented means, and to substantially restrict the movement of said latching bar to reciprocal movement.

2. The loose leaf binder mechanism as described in claim 1 further characterized in that said channel guide is a unitary construction having a top section and two side sections extending from said top section, said indented means including each of said side sections having an indentation opposite an indentation in the other side section so that said latching bar reciprocates between said indented means and said top section.

3. The loose leaf binder mechanism as set forth in claim 2 further characterized in that said channel guide includes first aperture for receiving said projection, and said latching bar includes a latching aperture having a straight side, and bias means between said channel guide and said latching bar for maintaining said straight side in said groove when the projection is in said first aperture.

4. The loose leaf binder mechanism as set forth in claim 3 further characterized in that said indented means are located substantially adjacent to said first aperture.

5. The loose leaf binder mechanism as set forth in claim 4 further characterized in that there is a second aperture in said channel guide, a second latching aperture is provided in said latching bar, a second projection with a groove thereon extends from said longitudinal bar, whereby said first and second apertures line up with said latching apertures to receive said projections.

6. The loose leaf binder mechanism as set forth in claim 5 further characterized in that a first pin aperture is provided in said channel guide, a pin member located in said pin aperture fixedly connects said channel guide to one of said covers, a limit aperture is provided in said latching bar whereby said limit aperture receives said pin member and restricts the reciprocal movement of said latching bar.

7. The loose leaf binder mechanism as set forth in claim 6 further characterized in that said channel guide includes a channel bias projection extending substantially perpendicular from said top section in the direction of said side sections, said latching bar includes a latching bias projection extending substantially perpendicular therefrom, a bias aperture means is provided in said latching bar for receiving said channel bias projection to permit restricted movement of the latching bar in the channel guide.

8. The loose leaf binder mechanism as set form in claim 7 further characterized in that said bias means is located between said channel bias projection and said latching bias projection.

9. The loose leaf binder mechanism as set forth in claim 8 further characterized in that a second pin aperture is provided on said channel guide in spaced relationship to said first pin aperture, a second pin member being located on said second pin aperture connects said channel guide to one of said covers, a second limit aperture is provided in said latching bar whereby said second limit aperture receives said second pin member and restricts reciprocal movement of said latching bar.

10. The loose leaf binder mechanism as set forth in claim 9 further characterized in that a projecting tab is located on the end of the latching bar for moving the latching bar towards said channel guide.

11. The loose leaf binder mechanism as set forth in claim 10 further characterized in that said projection for the longitudinal bar is cylindrical and said groove is circumferential.

12. A binder mechanism for use with a loose leaf binder comprising: a detachable longitudinal bar, said detachable longitudinal bar having a projection with a groove thereon extending therefrom, a channel guide, a flat latching bar reciprocally received within said channel guide for cooperating with said projection to join said longitudinal bar to said channel guide and indented means formed on the opposing sides of said channel guide and slidingly contacting the latching bar so as to provide a bearing surface as the latching bar slides between the top and sides of the channel guide, and the top of the indented means, and to substantially restrict the movement of said latching bar to reciprocal movement.

* * * * *